US008302546B2

(12) United States Patent
Bitzer et al.

(10) Patent No.: US 8,302,546 B2
(45) Date of Patent: Nov. 6, 2012

(54) TUFTING GRIPPER WITH SPRING-BIASED SUPPORT OF AN INSERT

(75) Inventors: Ingo Bitzer, Ledgen (DE); Andreas Englmeier, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/167,245

(22) Filed: Jun. 23, 2011

(65) Prior Publication Data

US 2012/0024209 A1 Feb. 2, 2012

(30) Foreign Application Priority Data

Jul. 28, 2010 (EP) ..... 10171111

(51) Int. Cl.
*D05C 15/08* (2006.01)

(52) U.S. Cl. ..... 112/80.5

(58) Field of Classification Search ..... 112/80.5, 112/80.52, 80.53, 80.55, 80.56, 80.57, 80.59, 112/80.71; 83/284, 689, 679
See application file for complete search history.

(56) References Cited

U.S. PATENT DOCUMENTS

| | | | | |
|---|---|---|---|---|
| 2,090,021 | A * | 8/1937 | Baynton et al. | 112/80.59 |
| 2,800,096 | A * | 7/1957 | Signoret | 112/80.59 |
| 3,138,126 | A | 6/1964 | Card | |
| 4,155,318 | A * | 5/1979 | Yamamoto | 112/80.59 |
| 4,522,132 | A * | 6/1985 | Slattery | 112/80.51 |
| 4,602,576 | A * | 7/1986 | Cox | 112/80.55 |
| 5,345,885 | A * | 9/1994 | Yoshino | 112/80.55 |
| 7,717,049 | B2 * | 5/2010 | Hillenbrand et al. | 112/80.55 |
| 8,082,862 | B2 * | 12/2011 | Hillenbrand et al. | 112/80.59 |
| 2009/0107371 | A1 | 4/2009 | Hillenbrand et al. | |

FOREIGN PATENT DOCUMENTS

| | | | |
|---|---|---|---|
| DE | 1485499 | A1 | 7/1969 |
| EP | 0200810 | A1 | 11/1986 |
| EP | 1953290 | A1 | 8/2008 |
| GB | 932625 | A | 7/1963 |
| GB | 1011371 | A | 11/1965 |

OTHER PUBLICATIONS

International Search Report dated Jan. 27, 2011.

* cited by examiner

*Primary Examiner* — Danny Worrell
(74) *Attorney, Agent, or Firm* — Fitch, Even, Tabin & Flannery, LLP

(57) ABSTRACT

A tufting gripper (16) comprises a pocket (26) with an insert (25) that is associated with a spring means (34) in order to at least temporarily clamp and secure said insert in place in the pocket in a prespecified position. The spring means (34) pushes the insert (25) preferably in the direction of the tip of the gripper and creates a particularly smooth transition at this location between the base body (19) of the tufting gripper (16) and the insert (25), in particular the tip (33) of said insert.

14 Claims, 2 Drawing Sheets

TUFTING GRIPPER WITH SPRING-BIASED SUPPORT OF AN INSERT

CROSS-REFERENCE TO RELATED APPLICATION

The present application claims the priority of European Patent Application No. 10 171 111.7, filed Jul. 28, 2010, the subject matter of which, in its entirety, is incorporated herein by reference.

BACKGROUND OF THE INVENTION

The invention relates to a tufting gripper for tufting machines for the manufacture of tufted goods, in particular for the manufacture of tufted goods with cut pile.

In tufting machines, tufting grippers are disposed to grip thread loops that have previously been formed by tufting needles, said needles punching a pile thread through a planar backing material. In order to produce cut pile, a large number of tufting grippers held on a sinker interact with cutting knives that are also held on a sinker and that carry out a cutting motion opposing the movement of the tufting grippers. In order to reduce wear on the cutting edge of the tufting gripper, said gripper frequently comprises an insert that is provided with the cutting edge. Such a tufting gripper has been known from EP 1 953 290. The gripper has a cutting insert consisting of a hard metal, said insert being placed in a pocket of the gripper body and being secured in said pocked by projections on the pocket edge. These projections have been produced by plastic deformation of the pocket edge. This arrangement, and this type of fastening of the insert, offers great advantages, in particular in instances in which the tufting gripper must exhibit a certain lateral flexibility and the hard-metal insert exhibits great stiffness. On the other hand, a certain gap must exist between the pocket edge and the hard-metal insert.

Some pile threads used for the manufacture of loop pile, but in particular for the manufacture of cut pile, comprise very fine filaments that slide freely along the lower edge of the tufting gripper and are also not supposed to become caught in gaps or steps between the insert and the gripper body. Even if such gaps are filled by hard solder, remaining steps can result in damage to the thread, which has to be prevented in order to achieve good product quality.

Considering this, it is the object of the invention to disclose a concept that permits the formation of high-quality pile, even in the case of pile threads that are difficult to process.

SUMMARY OF THE INVENTION

The above object generally is achieved by a tufting gripper in accordance with the invention that comprises a gripper body with a pocket into which an insert, for example, a cutting insert, an anti-sliding insert or a combined cutting and anti-sliding insert, can be set. A spring means is arranged on the pocket, said spring means being associated with the insert. When the insert is inserted in the pocket, the spring means clamps the insert in place in a force-fitting manner. Preferably, the spring force is directed toward the tip of the gripper body. Due to the spring force, the insert is positioned in a well-defined position and clamped in place. As a result, the gap size at the transition from the gripper body to the insert—in particular on the tip-side end of the pocket—is minimal or zero. The tufting gripper may be designed in such a manner that the clamping force applied by the spring means is sufficient to hold and fix the insert in place. Alternatively, it is possible to additionally secure the tufting gripper in its desired position with a material-bonding connecting means such as, for example, an adhesive or a solder. In this case, the spring means is disposed to prevent the slipping or misplacement of the insert while an adhesive is being applied and being hardened or while a solder is being applied and being hardened, and to achieve a controlled narrow gap width in the joining gap. The objective is to make the gap width as small as possible, ideally approaching zero. Due to the action of the spring means the exact positioning of the insert and the retention of this position can be ensured in the case of a material-bonding connection of the insert and gripper body, this being instrumental for the quality of the transition between the insert and the gripper body. The more precisely the insert is positioned, the smaller the joining gap becomes. Laterally impacting forces do not affect the fastening negatively while the connecting agent (adhesive, solder or the like) is solidifying. This also applies to welding processes used for connection such as, for example the application of laser weld spots, said spots connecting the pocket edge with the insert.

The pocket may have a bottom and thus be open only toward one side of the tufting gripper. It is also possible for the pocket to be open toward both flat sides. In this case, two different inserts may be arranged in the pocket, said inserts facing toward the two flat sides of the tufting gripper and having different surfaces. It is also possible to provide a combined insert that exhibits different surface properties on the sides facing away from each other. Preferably, the pocket edge is designed so as to be straight in transverse direction of the tufting gripper. In this case, the insert is held by friction while, or as long as, there is no solder or any other material-bonding connecting agent introduced. The pocket edge may also be provided with one or more undercuts that secure the insert in the pocket in a form-fitting manner. In this instance, the spring means preferably pushes the insert in the direction toward the gripper tip toward recesses that are appropriately formed in the pocket edge. The recesses or elevations provided on the pocket edge securely hold the insert—even during operation of the tufting gripper—without additional connecting means.

Preferably, the spring means is a spring tab that may be released on the edge of the pocket. Preferably, it consists of the material of the tufting gripper and adjoins said tufting gripper in a seamless and gapless manner. Preferably, the spring tab extends by more than three quarters of the corresponding lateral length of the insert, thus securely clamping in place said insert with sufficient elasticity on the one hand and with sufficient clamping force on the other hand.

In order to ensure the desired joint thickness, the insert or the gripper body may comprise spacing means, these being configured as knobs, for example. In doing so, it is possible to ensure the quality of the adhesive or solder joint.

Additional details of advantageous embodiments of the invention are the subject matter of the claims or the description and the drawings.

DETAILED DESCRIPTION OF THE INVENTION

Figure 1:
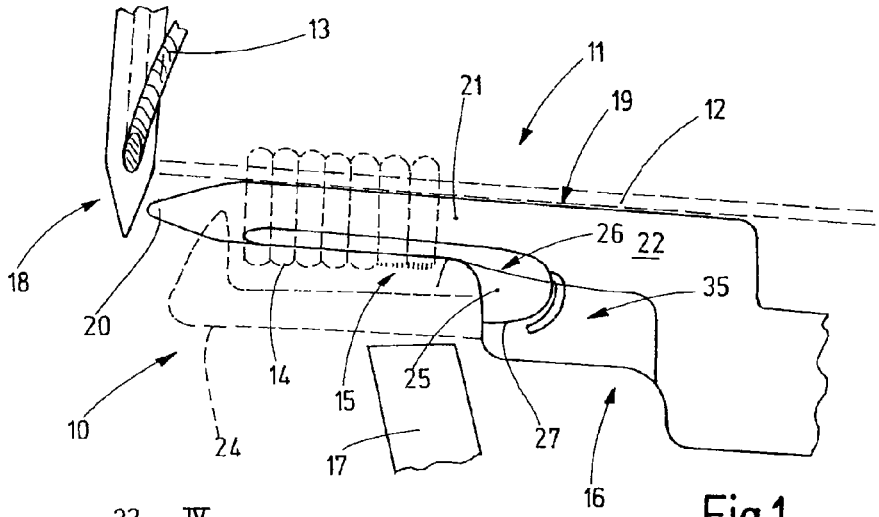
FIG. 1 is a schematized representation of a tufting device with the tufting gripper.

FIG. 1 shows a tufting device 10 that is disposed for the manufacture of pile goods 11 such as, for example, carpets and the like. The pile goods 11 comprise a planar backing material 12 to which loops 14 are applied with the use of a plurality of pile threads 13, said loops—once they are cut open—forming a cut pile 15. This is accomplished by means of a larger number of tufting grippers 16 held by a sinker, said grippers being associated with cutting knives 17. The pile thread 13 is punched through the backing material 12 by means of a group of tufting needles 18 held by a sinker. The resultant loops 14 are picked up by the tufting gripper 16. To do so, said tufting gripper comprises a gripper body 19 with a finger 21 extending toward a tip 20. The gripper body 19, including the finger 21, represents a flat component having two flat sides 22, 23 that may be plane or at least have plane sections. Slit-like passages are formed between the adjacent flat sides of adjacent tufting grippers 16, whereby the tufting needles 18 enter said passages so that, subsequently, the tufting grippers 16 can pick up the loops punched by the tufting needles 18 through the backing material 12.

In order to hold the loops on the finger 21 and keep them from sliding off, the tip 20 of the tufting gripper 16 may be angled downward in the form of a hook. However, as shown, said tip may also be located in the straight extension of the finger 21. In this case, the stitches may be prevented from sliding off by a spring 24 indicated in a dashed line in FIG. 1. This spring 24 may be a thin spring steel tab laterally abutting against the end of the finger 21.

The tufting gripper 16 is provided with an insert 25 that consists, for example of hard metal, ceramic or the like. The insert 25 is seated in a pocket 26 that is provided in the gripper body 19 and whose edge 27 follows the contour of the insert 25. The insert 25 may be configured as a cutting insert, for example. Said insert then extends over a longer section of the finger 21 and is arranged in the pocket 26. A cutting edge 28 (FIG. 3) may be provided on the wavy, toothed, straight, bent or stepped lower, for example horizontal, edge of the insert 25, said cutting edge interacting with the knife 17 when the loops 14 are being cut open.

As shown, the insert 25 may comprise two flat partial inserts 29, 30 that are superimposed in a contour-matched manner and optionally joined together, for example glued together, welded together or soldered together. These partial inserts may abut against each other or be joined together along a boundary surface 31 that is flat or provided with a profile. For example, the partial insert 30 is configured as a hard insert and defines the cutting edge 28. This partial insert may consist of hard material or be provided with a hard-material surface. In terms of this, hard materials comprise hard metals, metal carbides such as, for example, tungsten carbide, or also hard-material layers such as titanium nitride, titanium carbide, aluminum oxide, ceramic and the like. This ensures the wear resistance of the cutting edge 28.

Figure 4:
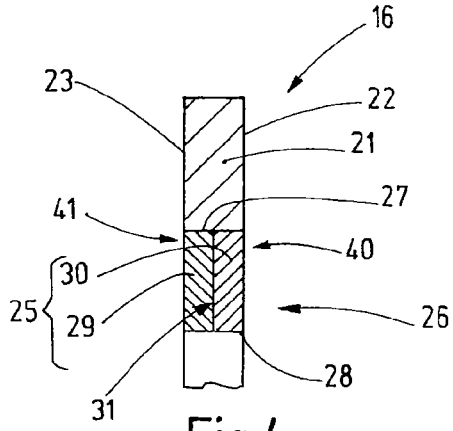
FIG. 4 is a sectional view, along line IV-IV in FIG. 2, of the tufting gripper in accordance with FIGS. 2 and 3.

The other insert 29 may be configured, for example, as an anti-sliding insert. It may consist of another material that reduces or eliminates damage to the needle when the needle sweeps along said anti-sliding insert. For example, this material may be a soft material, optionally a material displaying emergency lubricating properties, or it may be a particularly smooth material having a surface displaying a low coefficient of friction when the material is paired with that of tufting needle 18. The use of ceramics, in particular those with a glass-like surface, carbon or tin-filled metal matrices, carbon-nitride-coated surfaces or the like is possible. FIG. 4 shows the basic structure in cross-section. As can be seen, the edge 27 of the pocket 26 is straight in transverse direction, for example. Thus, the flat sides 22, 23 extend at a right angle with respect to the edge 27 of the pocket 26.

The tip-side end of the pocket 26 is preferably configured as a section 32 (FIGS. 2 and 3) that is short and arcuate, said section circumscribing the tip 33 of the insert 25 and thus extending under said tip. Viewed from below, the arcuate section 32 forms an undercut on the tip-side end of the pocket 26. This undercut secures the insert 25 on the finger 21 in vertical direction in a form-fitting manner. For example, the section 32 follows a cylindrical wall. Consequently, the insert 25 can be laterally inserted in the pocket 26 and then held in said pocket.

Figure 2:
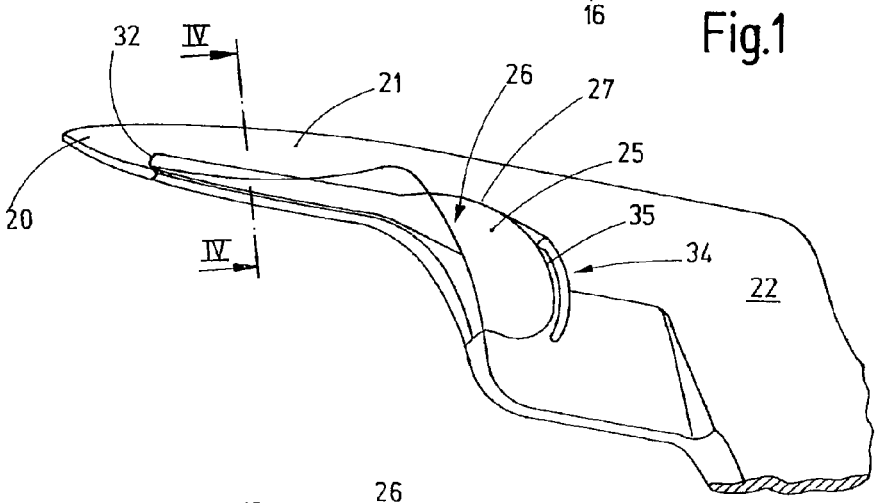
FIGS. 2 and 3 are different perspective representations of the tufting gripper in accordance with FIG. 1.
Figure 3:
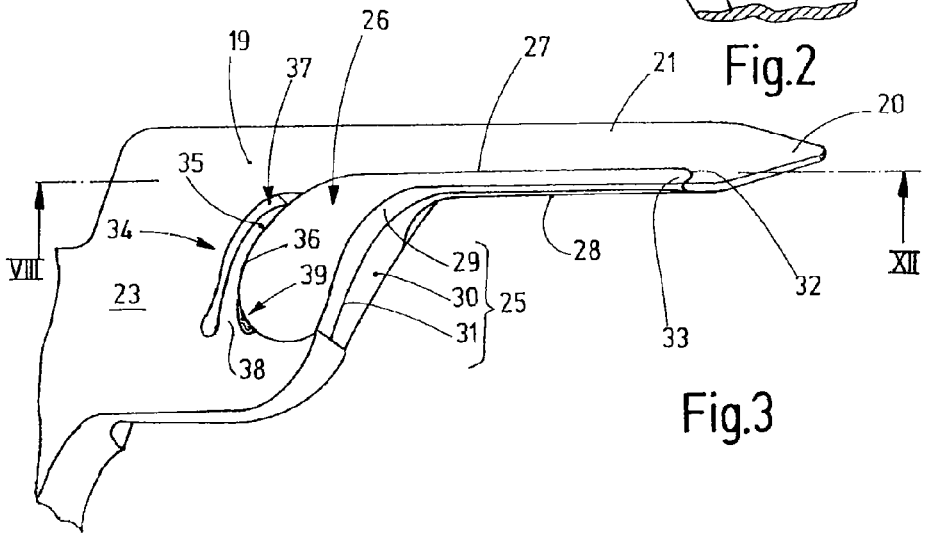

The end of the pocket 26 located on the opposite side in the section 32 preferably is represented as a spring means 34 that is disposed to push the insert 25 in the direction of the tip 20, i.e., into the end of the pocket 26, said end being adjacent to the tip 20. In principle, the spring means 34 may be arranged at another point of the pocket 26; however, the described arrangement on the rear pocket edge as shown in FIGS. 1 through 3 is preferred.

Preferably, the spring means 34 is a flexible spring 35 that comes into intimate contact with the contour 36 of the insert 25, i.e., follows said contour, said contour being opposite the tip 33. In the present example, the contour 36 is rounded in an arcuate manner. Likewise, the flexible spring 35 on the side facing the insert 25 is rounded in an arcuate manner. Consequently, the flexible spring 35 forms a part of the edge 27 of the pocket 26.

Preferably, the flexible spring 35 consists of the material of the gripper body 19, whereby a notch 37 is formed therein, said notch extending from the edge 27 and away from the edge 27 and then following said edge at a distance. As a result of this, the flexible spring 35 is released. As shown, said flexible spring may have a uniform thickness along its length from its tip to its end 38, i.e., its root, where it terminates in the gripper body 19. However, as indicated in FIG. 3, the flexible spring 35 may also display increasing thickness toward its root. In addition, said flexible spring may have a shallow indentation 39 in the vicinity of its root 38 on the side facing the pocket 26 in order to prevent the insert 25 from pushing against non-resilient or poorly resilient components of the flexible spring 35.

Figure 6:
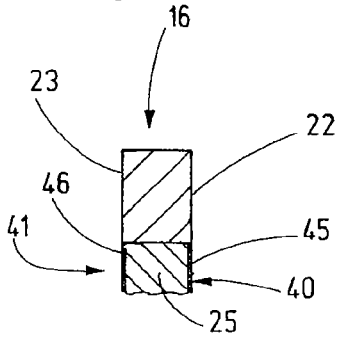
FIG. 6 is a sectional view analogous to FIG. 4, of another embodiment of the inventive tufting gripper.

Such a gripper 16 is assembled in that the insert 25 is pressed into the pocket 26 and positioned there as desired. In the desired position, the two flat sides 40, 41 of the insert 25 adjoin the flat sides 22, 23 of the gripper body 19 in a stepless manner and without offset (FIG. 6). Due to the clamping action of the flexible spring 35 or any other spring means 34, the tip 33 of the insert 25 is pushed into the arcuate end at the section 32 of the pocket 26. As a result of this, the insert 35 is clamped in place with respect to the transverse direction and is held in a form-fitting manner in vertical direction. Each gap or each step at the transition of the insert 25 to the gripper body 19 is minimal. If necessary, at least optionally, the insert 25 may be connected with the gripper body 19 in a material-bonding manner, for example, by gluing or soldering or welding. In the case of gluing, the spring means 34 ensures the secure seat of the insert in its desired position until the adhesive has fully hardened. In the case of soldering, this applies analogously until the solder has cooled and solidified. If welding is used for the connection, the resilient clamping action also fixes the insert in place. Consequently, in the case of a material-bonding connection of the insert 25 with the gripper body 19, the spring means 34 ensures the exact positioning of the insert 25, thus retaining said insert in its position. This is instrumental for the quality of the transition between the insert 25 and the gripper body 19. The more precise the insert 25 is positioned, the smaller does the gap or a step become. Lateral forces occurring while the material-bonding joint is solidifying do not have any negative influence on fastening.

Briefly, the tufting device 10 operates as follows:

During operation, the grippers 16 held on a sinker perform an oscillating movement, in the course of which they continuously pick up pile thread loops that are formed by the tufting needles 18 when puncturing the backing material 12. As is shown by FIG. 1, the loops 14 gather on the finger 21. Due to the advance of the backing material 12, the loops 14 picked up by the tufting griper 16 always slide away from the tip 20 of the tufting gripper 16. Inasmuch as the tip 33 is located in the pocket 26 and is covered by the arcuate section 32, it is ensured that none of the loops 14 can enter any gap between the edge 27 and the insert 25.

Many modifications are possible on the invention that has been illustrated so far. For example, the spring means 34 may consist of an independent component that is fastened to the edge 27 of the pocket 26 or is arranged in an appropriate recess. Furthermore, the material-bonding connection may be restricted to components or sections of the insert 25 or also take up the entire edge 27. In the first-mentioned case, the result is an increased elasticity in comparison with the tufting tools comprising inserts whose entire surfaces are connected by material-bonding. Consequently, the tufting tools in accordance with the invention are able to better respond to any impacting transverse forces that result from the cutting knife 17 of the tufting needle 18 or from the loops 14.

Furthermore, it is possible to provide the insert 25 with a spacing means 42 that creates a space defined between the insert 25 and the edge 27 along the edge 27 of the pocket 26 or at selected points of said edge. Such a spacing means 42 may be, for example, knobs 43, 44 that are provided on the outside circumference of the insert 25. Such knobs or ribs or other projections preferably have the same elevation as the potential thickness of the adhesive gap or solder gap. This is, for example, a few tenths of a millimeter.

FIG. 6 shows another possible modification. The insert 25 provided in this case comprises a body of a uniform material, said body being provided with a coating 45, 46 on its two flat sides 40, 41 that face a way from each other. Preferably, these coatings are of a different nature. For example, the coating 45 may be a hard-material layer that also circumscribes the cutting edge 28, whereas, for example, the coating 46 may be a soft friction-reducing coating. In this case the coating 45 interacts with the cutting edge 17, whereas the coating 46 interacts with the needle and, if possible, does not cause damage due abrasion to the needle.

Alternatively, the base body of the insert 25 may consist of a hard material that is provided with only the coating 46. In this case, the coating 45 may be omitted. Also alternatively, the insert 25 may consist of a soft, minimally abrasive material that is provided with the coating 45. In this case, the coating 46 may be omitted.

Figure 7:
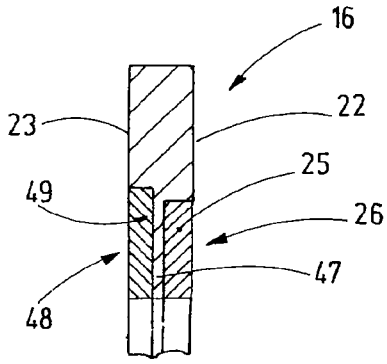
FIG. 7 is a sectional view analogous to FIG. 4, of an alternative embodiment of the inventive tufting gripper.
Figure 5:
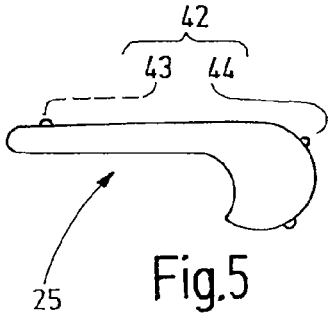
FIG. 5 is a schematized side view of the insert for the tufting gripper in accordance with FIGS. 1 through 4.

FIG. 7 shows another modification. It is based on the fact that the pocket 26 has a bottom 47. An additional pocket 48 may be provided on the opposite side of the tufting gripper 16. This pocket may be configured to have the same contour as the pocket 26 or it may have a different contour. This pocket has its own insert 49. Each of the inserts 25, 49 may be provided with a suitable spring means as has been previously explained, said spring means clamping the inserts 25, 49 in place in a desired joining position. It is also possible for the two separate inserts 25, 49 to be held in their joining position by a single spring means 34. To accomplish this, the gripper body 19 has an appropriate recess in which the spring means 34 is held and can exert a spring force on both inserts 25, 49.

Figure 8:
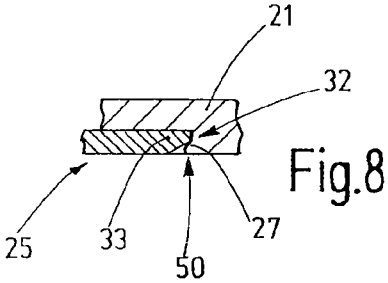
FIGS. 8 through 12 are longitudinal sectional views, in section along sectional line VIII-VII as in FIG. 3, of details of additional embodiments of the tufting gripper in accordance with the invention.
Figure 9:
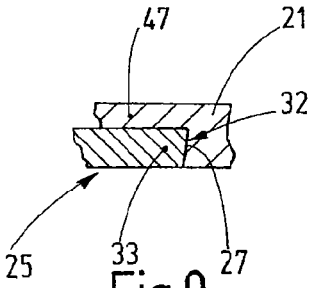

Considering the above description, it was assumed that the edge 27 is straight along its entire length relative to the transverse direction. As is shown by FIGS. 8 through 11, it is however also possible—at least locally—to deviate from this configuration of the edge. Each of these figures shows a horizontal sectional view in the region of the tip 33 of the insert 25. FIG. 8 shows that a small projection 50 may be provided on the edge 27, said projection also laterally securing the tip 37 in a form-fitting manner. In this case, the insert 25 need not be secured by material-bonding. This also applies when the edge 27, as shown by FIG. 9, is arranged or configured so as to be inclined counter the transverse direction Q.

Figure 10:
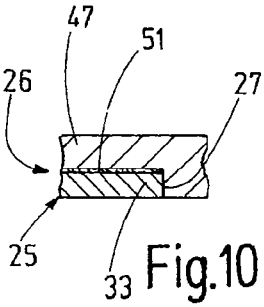

In contrast, FIG. 10 shows the configuration of the edge 27 without undercut, i.e., the orientation of said edge in transverse direction Q, in which case an adhesive 51 or solder provided between the bottom 47 of the pocket 26 and the insert 25 takes over the lasting lateral fixation of the insert 25.

Figure 11:
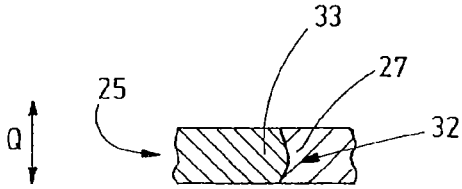
Figure 12:
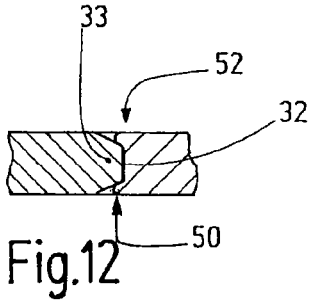

Also, as is shown by FIGS. 11 and 12 regarding the insert 25, said insert being continuous along the entire gripper thickness, there are options to secure said insert in a form-fitting manner relative to the transverse direction Q. As is shown by FIG. 12, for example, the edge 27 may deviate from the straight form in transverse direction, or have projections 50, 52, in the section 32 or also in other suitable sections.

A tufting gripper 16 comprises a pocket 26 with an insert 25 that is associated with a spring means 34 in order to at least temporarily clamp and secure said insert in place in the pocket in a prespecified position. The spring means 34 pushes the insert 25 preferably in the direction of the tip of the gripper and creates a particularly smooth transition at this location between the base body 19 of the tufting gripper 16 and the insert 25, in particular the tip 33 of said insert.

It will be appreciated that the above description of the present invention is susceptible to various modifications, changes and modifications, and the same are intended to be comprehended within the meaning and range of equivalents of the appended claims.

LIST OF REFERENCE NUMERALS

10 Tufting device
11 Pile goods
12 Backing material
13 Pile filaments
14 Loops
15 Cut pile
16 Tufting gripper
17 Cutting knife
18 Tufting needles
19 Gripper body
20 Tip
21 Finger
22 First flat side of the tufting gripper 16
23 Second flat side of the tufting gripper 16
24 Spring for holding the loops 14 on the finger 21
25 Insert
26 Pocket
27 Edge of the pocket 26

28 Cutting edge
29 Partial insert
30 Partial insert
31 Boundary surface
32 Arcuate section of the edge 27 of the pocket 26
33 Tip of the insert 25
34 Spring means
35 Flexible spring
36 Contour
37 Notch
38 Root
39 Indentation
40 First flat side of the insert 25
41 Second flat side of the insert 25
42 Spacing means
43 Knobs
44 Knobs
45 Coating of hard material
46 Coating exhibiting sliding properties
47 Bottom
48 Pocket
49 Insert
50 Projection for laterally securing the insert 25
51 Adhesive
52 Projection for laterally securing the insert 25

What is claimed is:

1. Tufting gripper (16) for a tufting machine, said tufting gripper comprising:

a gripper body (19)

an insert (25) that is arranged in a pocket (26) of the gripper body (19), a spring means (34) that is arranged on the pocket (26) and is configured to effect a force on the insert (25).

2. Tufting gripper as in claim 1, characterized in that the gripper body (19) has two flat sides (22, 23), and that the pocket (26) is open toward at least one flat side (22, 23).

3. Tufting gripper as in claim 2, characterized in that the pocket (26) is open toward both flat sides (22, 23).

4. Tufting gripper as in claim 2, characterized in that the pocket (26) has an edge (27) that is straight in a transverse direction (Q) extending from the flat side (22) to the flat side (23).

5. Tufting gripper as in claim 1, characterized in that the spring means (34) is arranged on an edge (27) of the pocket (25).

6. Tufting gripper as in claim 1, characterized in that the spring means (34) exerts a clamping force on the insert (25), said spring force holding the insert in a force-fitting manner when, or as long as, there is no material-bonding connection between the insert (25) and the gripper body (19).

7. Tufting gripper as in claim 1, characterized in that the spring means (34) is formed by a spring tab (35) whose one end (38) is connected with the gripper body (19) and abuts against the insert (25).

8. Tufting gripper as in claim 7, characterized in that the spring tab (35) consists of the material of the gripper body (19).

9. Tufting gripper as in claim 1, characterized in that the length of the spring tab (35) exceeds three quarters of the length of the side of the insert (25), the spring tab (35) abutting against said side.

10. Tufting gripper as in claim 1, characterized in that the insert (25) is secured in the pocket (26) in a material-bonding manner.

11. Tufting gripper as in claim 1, characterized in that spacing means (42) are provided on the insert (25) or the pocket (26) in order to define the gap width of the resultant joining gap between the insert (25) and the gripper body (19) in a controlled manner.

12. Tufting gripper as in claim 1, characterized in that the spacing means (42) are ribs or knobs (44).

13. Tufting gripper as in claim 1, characterized in that the insert (25) adjoins at least one flat side (22, 23) of the gripper body (19) in a smooth and stepless manner.

14. Tufting gripper as in claim 1, characterized in that the insert (25) adjoins two flat sides (22, 23) of the gripper body (19) in a smooth and stepless manner.

* * * * *